US007647987B2

(12) United States Patent
Cole

(10) Patent No.: US 7,647,987 B2
(45) **Date of Patent: *Jan. 19, 2010**

(54) MULTIPLE ANTENNA SYSTEM FOR HORIZONTAL DIRECTIONAL DRILLING

(75) Inventor: Scott B. Cole, Edmond, OK (US)

(73) Assignee: The Charles Machine Works, Inc., Perry, OK (US)

( * ) Notice: Subject to any disclaimer, the term of this patent is extended or adjusted under 35 U.S.C. 154(b) by 208 days.

This patent is subject to a terminal disclaimer.

(21) Appl. No.: 11/068,170

(22) Filed: Feb. 28, 2005

(65) Prior Publication Data

US 2005/0189143 A1 Sep. 1, 2005

Related U.S. Application Data

(60) Provisional application No. 60/548,052, filed on Feb. 26, 2004, provisional application No. 60/568,062, filed on May 4, 2004.

(51) Int. Cl.
*E21B 47/02* (2006.01)

(52) U.S. Cl. ..... 175/45; 175/61

(58) Field of Classification Search ..... 175/45, 175/61; 340/853.2, 853.3, 853.4, 853.5, 340/853.6

See application file for complete search history.

(56) References Cited

U.S. PATENT DOCUMENTS

| | | | | |
|---|---|---|---|---|
| 4,710,708 | A | 12/1987 | Rorden et al. | 324/207 |
| 4,812,812 | A * | 3/1989 | Flowerdew et al. | 340/853.6 |
| 5,442,294 | A * | 8/1995 | Rorden | 324/339 |
| 5,652,593 | A * | 7/1997 | Rench et al. | 342/458 |
| 5,957,222 | A | 9/1999 | Webb et al. | 175/45 |
| 6,035,951 | A * | 3/2000 | Mercer et al. | 175/45 |
| 6,476,609 | B1 * | 11/2002 | Bittar | 324/338 |
| 7,111,693 | B1 * | 9/2006 | Self et al. | 175/40 |
| 2003/0056984 | A1 * | 3/2003 | Smith et al. | 175/40 |

* cited by examiner

*Primary Examiner*—Jennifer H Gay
*Assistant Examiner*—David Andrews
(74) *Attorney, Agent, or Firm*—Tomlison & O'Connell, PC

(57) ABSTRACT

A system for monitoring the position of a downhole tool assembly having multiple beacons. In a preferred embodiment first and second beacons are adapted to transmit electromagnetic signals indicative of the position of the downhole tool assembly. A receiving assembly having a single antenna arrangement detects the signals transmitted from the first and second beacons. The receiving assembly processes the signals to determine the relative position of the receiving assembly to the downhole tool assembly. The determination of the relative position comprises determining a lateral offset and a distance from the downhole tool assembly.

18 Claims, 6 Drawing Sheets

MULTIPLE ANTENNA SYSTEM FOR HORIZONTAL DIRECTIONAL DRILLING

CROSS REFERENCE TO RELATED APPLICATIONS

This application claims priority of U.S. Provisional Patent Application Ser. No. 60/548,052, filed Feb. 26, 2004, and U.S. Provisional Patent Application Ser. No. 60/568,062, filed May 4, 2004.

FIELD OF THE INVENTION

The present invention relates to an apparatus and method for locating and tracking horizontal directional boreholes and more particularly, to the use of multiple antennas in the underground system.

SUMMARY OF THE INVENTION

The present invention is directed to a system for use with a horizontal directional drilling machine to monitor a position of a downhole tool assembly. The system comprises a downhole tool assembly and a receiving assembly. The downhole tool assembly comprises a first beacon adapted to transmit a first electromagnetic signal, and a second beacon spatially separated from the first beacon and adapted to transmit a second electromagnetic signal. The receiving assembly comprises a single antenna arrangement and a processor. The antenna arrangement comprises three mutually orthogonal antennas, each antenna adapted to detect the signals emanating from the first beacon and the second beacon. The processor is adapted to receive the detected signals from the antenna arrangement and to process the detected signals to determine a relative position of the receiving assembly to the downhole tool assembly.

In another aspect the present invention is directed to a method for monitoring a position of a downhole tool assembly during a horizontal drilling operation. The downhole tool assembly comprises a first beacon and a second beacon both supported by the downhole tool assembly, and the first beacon is adapted to transmit a first locating signal and the second beacon is adapted to transmit a second locating signal. The method comprises detecting at a monitoring point the first locating signal transmitted by the first beacon and the second locating signal transmitted by the second beacon, and processing the detected first and second locating signals to determine a relative position of the monitoring point to the first beacon.

In yet another aspect, the present invention comprises a method of calibrating a receiving assembly for use with a downhole tool assembly during a horizontal drilling operation. The downhole tool assembly comprises a first beacon and a second beacon each adapted to transmit a locating signal. The method comprises moving the receiving assembly in a direction parallel to the first beacon and the second beacon, detecting the locating signals transmitted by the first beacon and the second beacon, and determining a constant value k for the first beacon when a strength of the signals received from the first beacon and the second beacon is the same.

DESCRIPTION OF THE PREFERRED EMBODIMENTS

Figure 1:
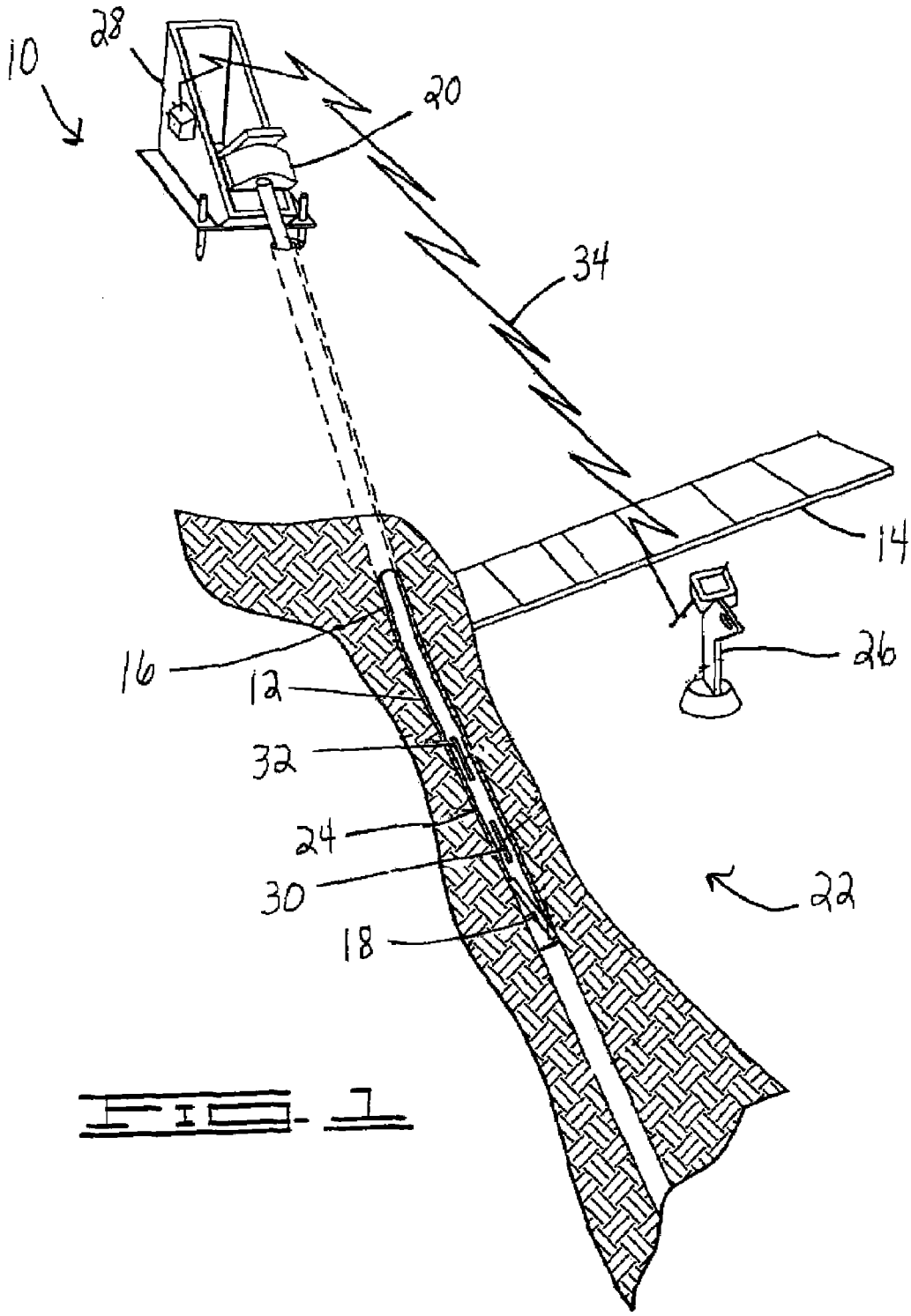
FIG. 1 is a diagrammatic representation of a horizontal directional drilling system having a monitoring system constructed in accordance with the present invention.

Turning now to the drawings in general and FIG. 1 in particular, there is shown therein a horizontal directional drilling ("HDD") system 10 constructed in accordance with the present invention. FIG. 1 illustrates the usefulness of horizontal directional drilling by demonstrating that a borehole 12 can be made without disturbing an above-ground structure, namely a roadway or walkway as denoted by reference numeral 14. To cut or drill the borehole 12, a drill string 16 carrying a drill bit 18 is rotationally driven by a rotary drive system 20. When the HDD system 10 is used for drilling a borehole 12, monitoring the position of the drill bit 18 is critical to accurate placement of the borehole and subsequently installed utilities. The present invention is directed to a system 22 and method for monitoring a downhole tool assembly 24 during a horizontal directional drilling operation.

The HDD system 10 of the present invention is suitable for near-horizontal subsurface placement of utility services, for example under the roadway 14, building, river, or other obstacle. The monitoring system 22 for use with the HDD system 10 is particularly suited for providing an accurate three-dimensional locate of the downhole tool assembly 24 from any position above ground. The locating and monitoring operation with the present monitoring system is advantageous in that it is accomplished in a single operation. The present invention also permits the position of the downhole tool assembly 24 to be monitored without requiring an above ground receiving assembly or tracker 26 be placed directly over a transmitter in the downhole tool assembly. The present invention eliminates guesswork on the part of the tracker operator and improves accuracy in locating the downhole tool assembly 24. These and other advantages associated with the present invention will become apparent from the following description of the preferred embodiments.

With continued reference to FIG. 1, the HDD system 10 comprises the drilling machine 28 operatively connected by the drill string 16 to the downhole tool assembly 24. The downhole tool assembly 24 preferably comprises the drill bit 18 or other directional boring tool, a first beacon 30 and a second beacon 32. The beacons 30 and 32 function to communicate information to the receiving assembly 26 in a manner yet to be described. The progression of the borehole 12 along a desired path is facilitated by further communication of information between the receiving assembly 26 and controls for the HDD system 10. The line 34 represents a radio communication connection between the receiving assembly 26 and the drilling machine 28. Use of the drilling machine 28 in a traditional manner may be as disclosed in commonly assigned copending U.S. patent application Ser. No. 10/724,572, the contents of which are incorporated herein by reference.

Figure 2:
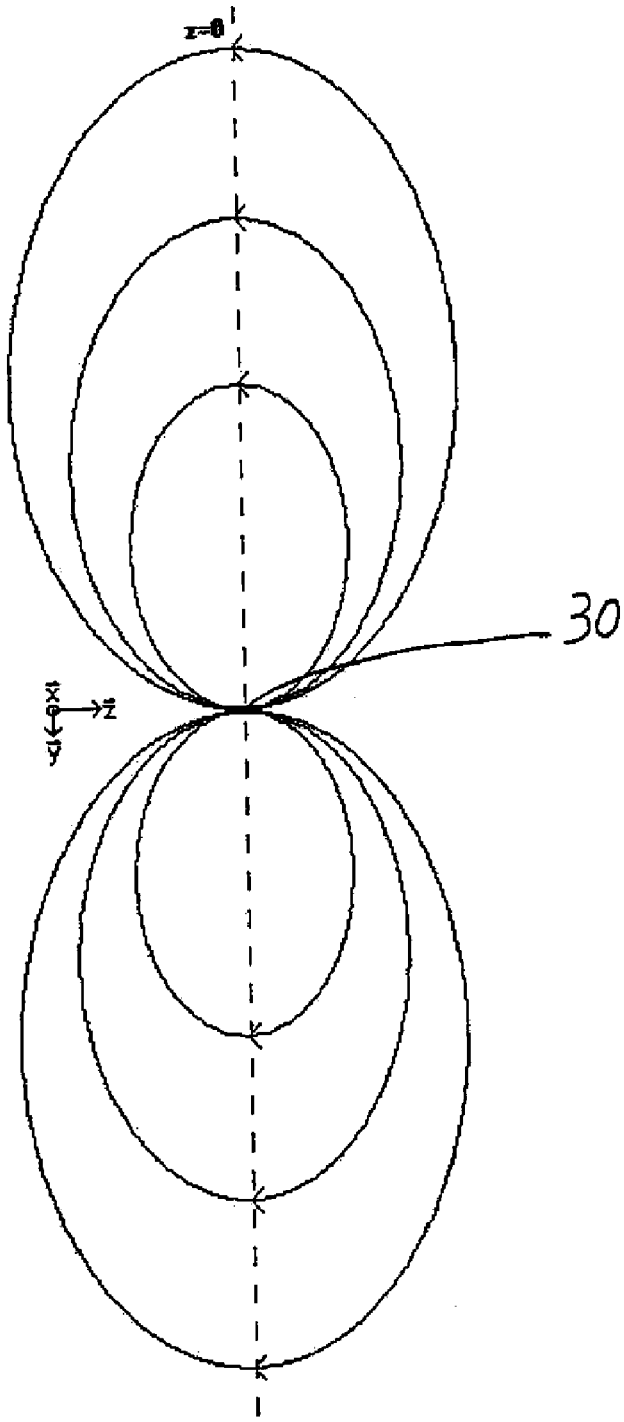
FIG. 2 is a diagrammatic representation of an overhead view of dipole field lines from an electromagnetic transmitter.

In accordance with the present invention, the present position of the directional boring tool 18 is determined using the monitoring system 22 comprised of the beacons 30 and 32 and a walkover receiving assembly 26 as to be described herein. Preferably, the first beacon 30 and the second beacon 32 comprise transmitters adapted to transmit an electromagnetic field. More preferably, the beacons 30 and 32 comprise a single dipole antenna adapted to transmit a dipole field, as shown in FIG. 2. Most preferably, the beacons comprise a ferrite rod core antenna although other transmitting mechanisms will work.

As is known in the art, a receiver may be used to determine the location of a single transmitter emitting a dipole field by using the amplitude and phase of the orthogonal components of the dipole field from the transmitter. One skilled in the art will appreciate a receiver can locate a transmitter in the fore-aft direction using the amplitude and phase of the transmitter's generated horizontal and vertical field components as measured in the vertical plane normal to the surface and extending through the transmitter axis. A receiver can also determine the location of a single transmitter in the left-right directions using the amplitude and phase of the dipole field in the horizontal plane. However, the left-right determination can only be used either in front of or behind the transmitter because when the receiver is directly above the transmitter (such that z=0), there is no y component to the dipole field. The equations for the dipole field, shown below, cannot be resolved in such a situation.

$$B = \frac{1}{4}\cdot k\cdot\frac{\sin(\theta)}{r^3}\vec{\theta} + \frac{1}{2}\cdot k\cdot\frac{\cos(\theta)}{r^3}\vec{r}$$

$$B = \frac{3}{4}\cdot k\cdot\frac{x\cdot z}{(x^2+y^2+z^2)^{5/2}}\vec{x} + \frac{3}{4}\cdot k\cdot\frac{y\cdot z}{(x^2+y^2+z^2)^{5/2}}\vec{y} + \frac{1}{4}\cdot k\cdot\frac{2\cdot z^2-x^2-y^2}{(x^2+y^2+z^2)^{5/2}}\vec{z}$$

Figure 3:
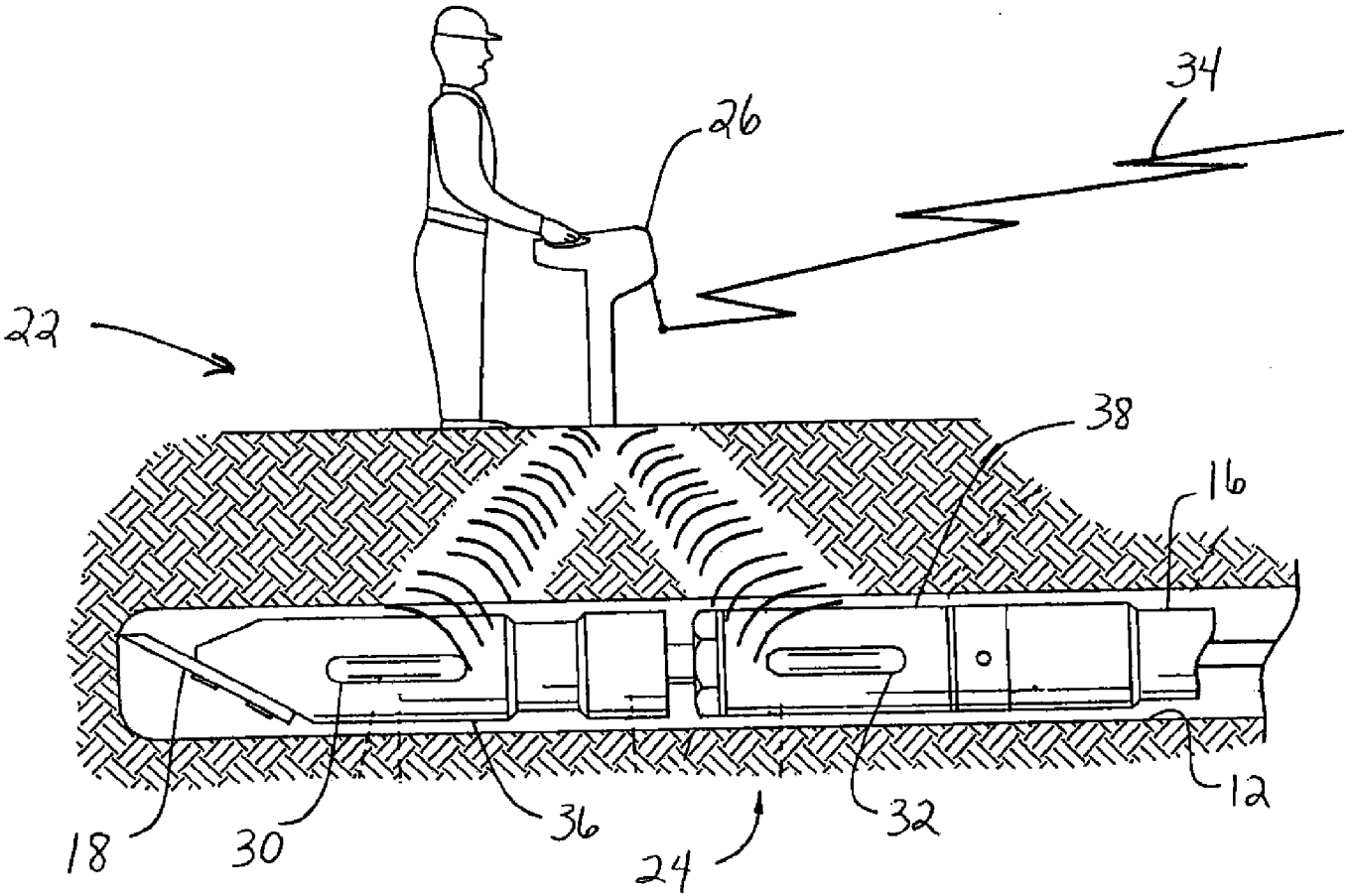
FIG. 3 is a side view of a system built in accordance with the present invention, showing a downhole tool assembly disposed within a borehole and a walkover receiving assembly.

With reference now to FIG. 3, there is shown therein the monitoring system 22 constructed in accordance with the present invention. In the preferred embodiment, first beacon 30 and the second beacon 32 are supported in housings 36 and 38 in a known manner. The housings 36 and 38 are connected to the drill bit 18, with the first beacon 30 proximate the drill bit. The second beacon 32 is remote from the drill bit 18, separated by a known distance from the first beacon. Although the beacons 30 and 32 are shown in separate housings 36 and 38, one skilled in the art will appreciate two antennas may be disposed in a single beacon or in a single housing. Additionally, it will be appreciated that the beacons may contain other sensors (not shown) as deemed appropriate, such as pitch, roll, and temperature sensors. Information from other sensors may be communicated from the beacons 30 and 32 in a known manner.

Preferably, the frequency transmissions of beacons 30 and 32 will be fixed at distinct and unique frequencies. The present invention contemplates that the chosen frequencies be within the range of beacon frequencies suitable for HDD applications, and that their transmissions be sufficiently distinct. The beacons 30 and 32 will preferably be positioned in close proximity (less than 10 feet of separation) and transmit to one receiving assembly 26. One skilled in the art will appreciate that increasing the separation of the beacons 30 and 32 will improve depth utility and accuracy. Thus, use of distinct frequencies and electronics to minimize cross-talk and maximize detection is preferable. Although not required, the lower of the two frequencies may be assigned to forward first beacon 30.

Figure 4:
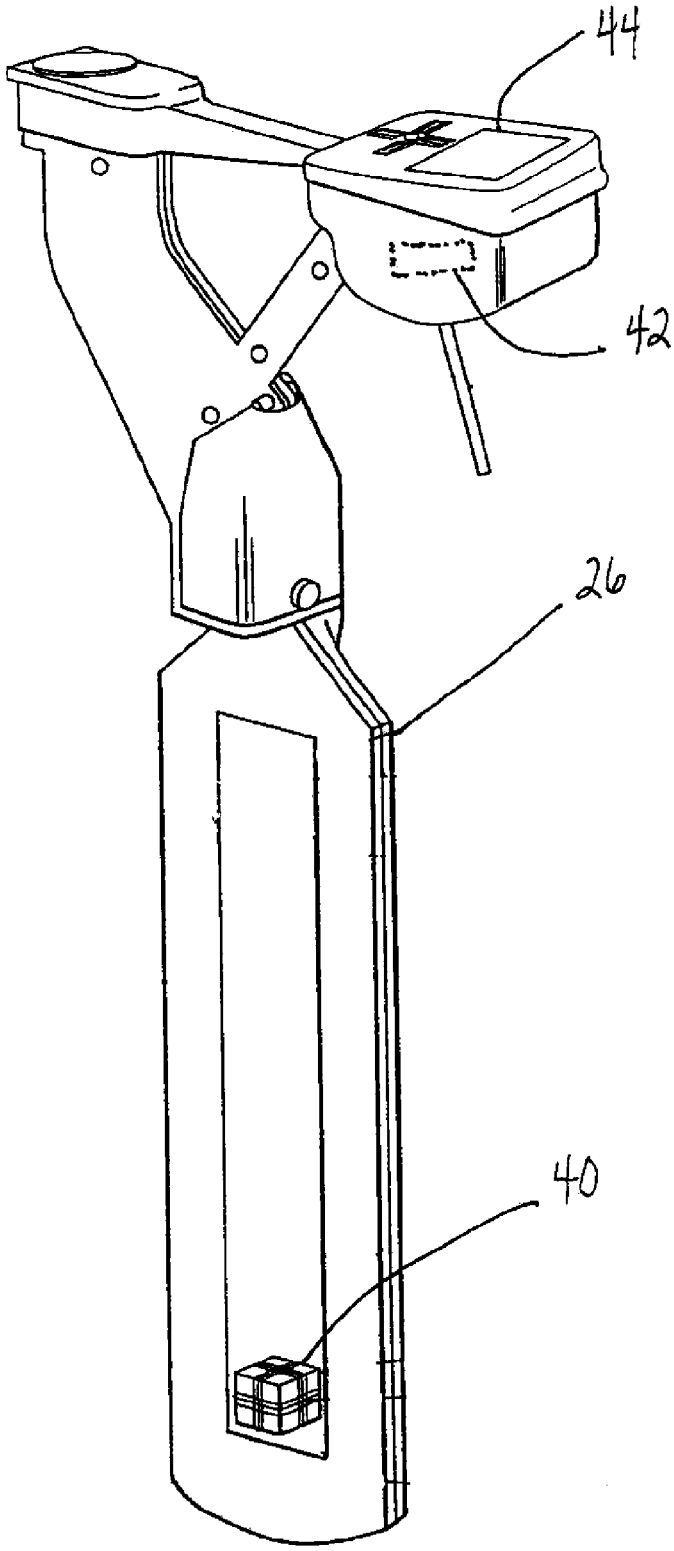
FIG. 4 is a perspective, partially cut-away view of a walkover receiving assembly constructed in accordance with the present invention.

Turning now to FIG. 4, shown therein is a receiving assembly 26 for use with the monitoring system of the present invention. The receiving assembly comprises a single antenna arrangement 40, a processor 42, and a display 44. Preferably, the antenna arrangement 40 comprises three mutually orthogonal antennas. The antennas are adapted to detect the orthogonal components of the dipole field transmitted by the beacons 30 and 32. Preferably, the antennas comprise ferrite rod antennas. Alternatively, the antennas may comprise circuit boards and could be arranged as a cubic antenna.

The receiving assembly 26 may further comprise filtering circuits (not shown) appropriate to filter the signals of separate frequencies from the first beacon and the second beacon. One skilled in the art will also appreciate the use of appropriate electronics (not shown) for the amplification of the outputs of the antennas, a multiplexer (not shown), an A/D converter (not shown), batteries (not shown), and other items necessary for system operation.

The processor 42 within the receiving assembly is operatively connected to the antenna arrangement 40 and the filtering circuits. The processor 42 receives the signals detected by the antenna arrangement 40. The processor 42 then determines the position of the receiving assembly 26 relative to the downhole tool assembly 24. The information contained in the multiple dipole fields allows the processor 42 to accurately locate the beacons 30 and 32 in 3-dimensional space. Use of the antenna arrangement 40 and two beacons 30 and 32 provides that three distinguishable orthogonal components of a magnetic field are available at any receiver assembly 26 position. Thus, when the receiver assembly 26 is directly above the first beacon 30, such that the y component of the field from the first beacon cannot be resolved, all three orthogonal components of the field from the second beacon 32 are still available.

Figure 5:
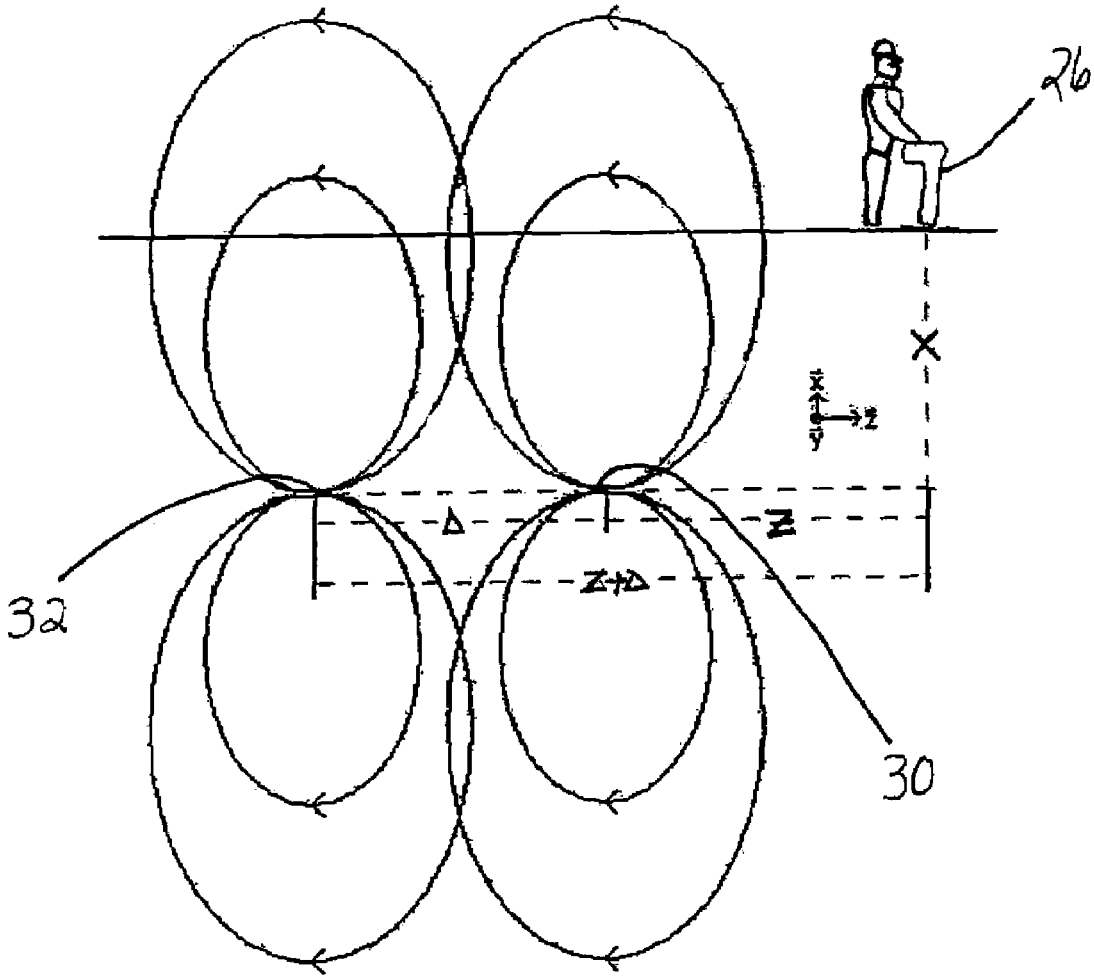
FIG. 5 is a diagrammatic side view of the monitoring system in use, showing dipole fields transmitted by the beacons.

With the two separate beacons 30 and 32 operating at distinct frequencies, the equations for the fields are:

$$B_f = \frac{3}{4}\cdot k_f\cdot\frac{x\cdot z}{(x^2+y^2+z^2)^{5/2}}\vec{x} + \frac{3}{4}\cdot k_f\cdot\frac{y\cdot z}{(x^2+y^2+z^2)^{5/2}}\vec{y} + \frac{1}{4}\cdot k_f\cdot\frac{2\cdot z^2-x^2-y^2}{(x^2+y^2+z^2)^{5/2}}\vec{z} \text{ and}$$

$$B_r = \frac{3}{4}\cdot k_r\cdot\frac{x\cdot(z-\Delta)}{(x^2+y^2+(z-\Delta)^2)^{5/2}}\vec{x} + \frac{3}{4}\cdot k_r\cdot\frac{y\cdot(z-\Delta)}{(x^2+y^2+(z-\Delta)^2)^{5/2}}\vec{y} + \frac{1}{4}\cdot k_r\cdot\frac{2\cdot(z-\Delta)^2-x^2-y^2}{(x^2+y^2+(z-\Delta)^2)^{5/2}}\vec{z}$$

where the subscript f denotes the first beacon 30 and the subscript r denotes the second beacon 32, a distance Δ behind the first beacon. The physical relationships of the beacons 30 and 32 to the receiving assembly 26 are shown by example in FIG. 5. These equations can alternatively be written as six equations with three unknowns:

$$B_{f,x} = \frac{3}{4} \cdot k_f \cdot \frac{x \cdot z}{(x^2 + y^2 + z^2)^{5/2}} \quad B_{r,x} = \frac{3}{4} \cdot k_r \cdot \frac{x \cdot (z - \Delta)}{(x^2 + y^2 + (z - \Delta)^2)^{5/2}}$$

$$B_{f,y} = \frac{3}{4} \cdot k_f \cdot \frac{y \cdot z}{(x^2 + y^2 + z^2)^{5/2}} \quad B_{r,y} = \frac{3}{4} \cdot k_r \cdot \frac{y \cdot (z - \Delta)}{(x^2 + y^2 + (z - \Delta)^2)^{5/2}}$$

$$B_{f,z} = \frac{1}{4} \cdot k_f \cdot \frac{2 \cdot z^2 - x^2 - y^2}{(x^2 + y^2 + z^2)^{5/2}} \vec{z} \quad B_{r,z} = \frac{1}{4} \cdot k_r \cdot \frac{2 \cdot (z - \Delta)^2 - x^2 - y^2}{(x^2 + y^2 + (z - \Delta)^2)^{5/2}} \vec{z}$$

If $z \neq 0$ and $z - \Delta \neq 0$, then all six equations can be used to solve for x, y, and z. If $z=0$, a condition existing when the receiving assembly is directly above the first beacon 30, then $B_{f,x}=B_{f,y}=0$ and we are left with four usable equations. Also, if $z-\Delta=0$, then $B_{r,x}=B_{r,y}=0$ and we are left with four equations. However, the only unknowns are x, y, and z. One skilled in the art will appreciate that these equations are solvable in a number of ways. This allows the fore-aft and left-right locations to be determined even with the receiving assembly 26 directly over the first beacon 30, or the second beacon 32.

With reference again to FIG. 4, the display 44 of the receiving assembly 26 can indicate the positional information determined by the processor 42. When the coordinate position for a monitoring point of the receiving assembly 26 relative to the downhole tool assembly 24 has been determined, positional information of the downhole tool assembly can be communicated to the display 44 of the receiving assembly. The receiving assembly 26 can, for example, indicate the distance from the receiving assembly to the downhole tool assembly 24, the lateral offset of the receiving assembly from the downhole tool assembly, or other appropriate information. The lateral offset of the receiving assembly 26 may be indicated by providing a distance from the receiving assembly to the downhole tool assembly 24 and a direction to a point or position directly above the downhole tool assembly. Consequently, the information can be displayed in a form that allows the user to understand the precise location of the downhole tool assembly 24 relative to the receiving assembly 26.

One skilled in the art will appreciate that the discussion of the preferred embodiment above involves a determination of the location of the first beacon 30 because of its close proximity in the downhole tool assembly 24 to the drill bit 18. The resulting position determinations can be further manipulated based on physical relationships, to indicate the positions of any or all of the first beacon 30, the second beacon 32, and the drilling bit 18. Furthermore, the measurements and positional determinations are based on certain assumptions that can otherwise be accounted for. For example, in the preferred embodiment described above, the receiving assembly 26 is assumed to be pointed in the same direction as the downhole tool assembly 24. However, if the pitch of the downhole tool assembly 24 is such that the receiving assembly 26 is not parallel to and pointed in the same direction as the first beacon 30 and the second beacon 32, measurements from one or more pitch sensors in the downhole tool assembly can be factored into the positional relationship determinations.

The present invention also contemplates a method for calibrating the antenna arrangement 40 of the receiving assembly 26 to the beacons 30 and 32 in the downhole tool assembly 24. Calibration is necessary in order to identify an appropriate constant $k_i$ (for each of the beacons) for the equations above. When the constant $k_i$ has been determined for each beacon 30 and 32, the constant will remain useful for the beacon so long as the power output of the beacon remains substantially constant. For those purposes, the output of the beacons 30 and 32 may be regulated in a known manner.

The process of calibration requires that the downhole tool assembly 24, and more preferably the beacons 30 and 32, be placed in the configuration in which they will be used during the boring operation. Preferably, the beacons 30 and 32 will be appropriately powered and transmitting the electromagnetic fields at their respective frequencies.

The calibration may be accomplished either prior to drilling or during drilling with the downhole tool assembly 24 in the ground. Preferably, the receiving assembly 26 and the antenna arrangement 40 will be pointed in a direction substantially similar to a direction in which the beacons 30 and 32 of the downhole tool assembly 24 are pointed. In the preferred embodiment, the downhole tool assembly 24 may be placed on a substantially horizontal surface of the ground as shown in FIG. 6.

Figure 6:
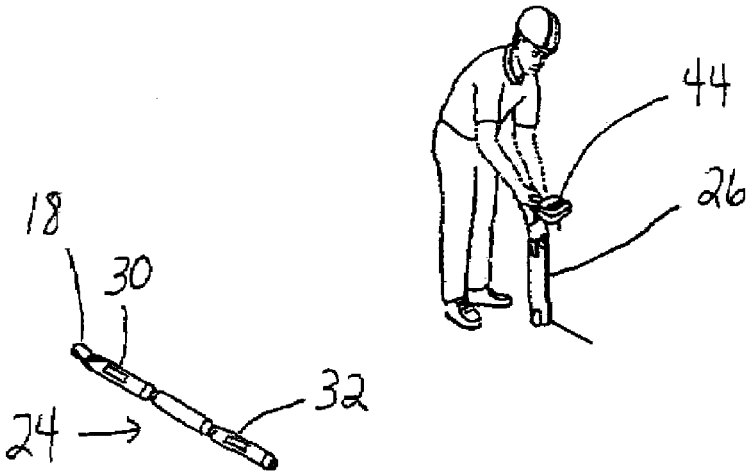
FIG. 6 is a partial perspective view of the monitoring system as the system is calibrated.
Figure 7:
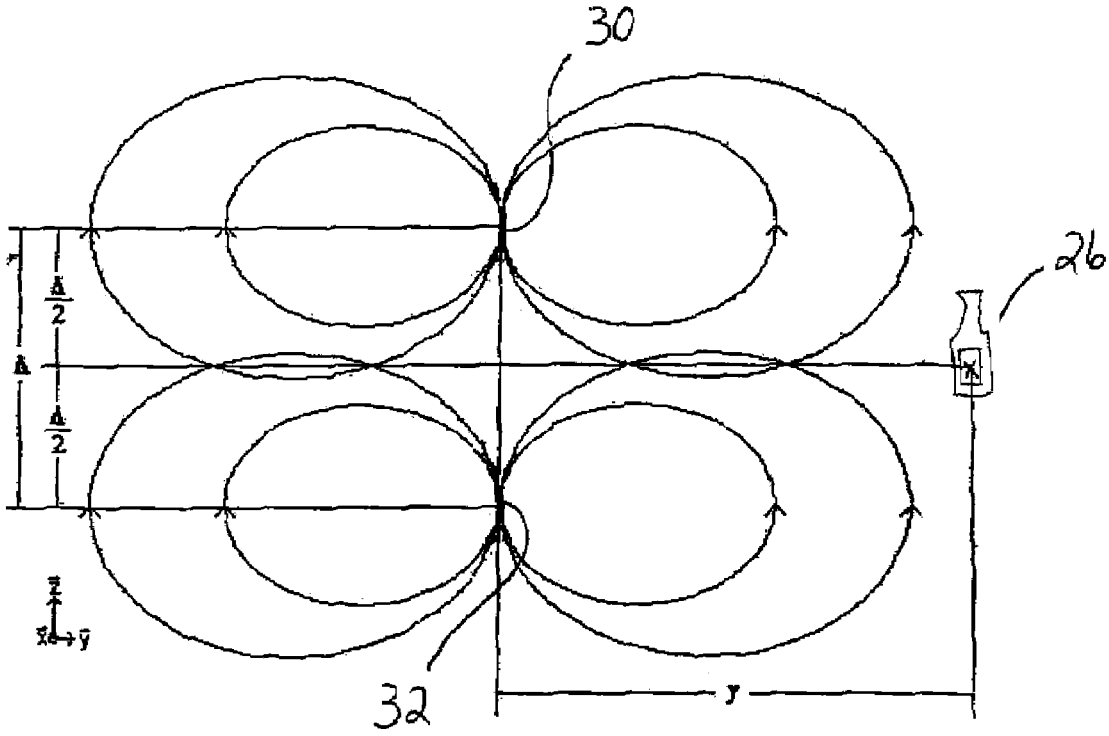
FIG. 7 is an overhead view and representation of the magnetic fields from the system during calibration.

The receiving assembly 26 and the antenna arrangement 40 are positioned parallel to and in the same horizontal plane as the downhole tool assembly 24, also as shown in FIG. 6. Such an arrangement is preferable such that the x-axis coordinate component (as shown in FIG. 7) is maintained at 0. If, however, the antenna arrangement 40 is not able to be maintained in the same horizontal plane as the downhole tool assembly 24, the equations can be appropriately manipulated with pitch information obtained from sensors in the downhole tool assembly. Preferably, the receiving assembly 26 will be held approximately the same distance from the downhole tool assembly 24 as the beacons 30 and 32 are separated (denoted by $\Delta$ as shown in FIG. 7). The side on which the receiving assembly is maintained is also not important.

The receiving assembly 26 is then moved parallel to and in the same horizontal plane (along the z-axis as shown in FIG. 7) as the first beacon 30 and the second beacon 32 of the downhole tool assembly 24. The antenna arrangement 40 detects a strength of the signals received from the first beacon and the second beacon in that configuration. When the position of the receiving assembly 26 along the z-axis is exactly between the first beacon 30 and the second beacon 32, the signal strength ratio $|B_{1,y}/B_{1,z}|=|B_{2,y}/B_{2,z}|$ will necessarily be true. The processor 42 of the receiving assembly 26 can be programmed to indicate movement of the receiving assembly is to stop. The processor will then determine the constant $k_i$ using the strength of the signals received from the first beacon and the second beacon and the distance between the first beacon and the second beacon in accordance with the following equations.

The ratio for the y and z components of the field would be $$\frac{B_{i,y}}{B_{i,z}} = 3 \cdot \frac{y \cdot z}{2 \cdot z^2 - y^2}.$$

The ratio $|B_{1,y}/B_{1,z}|=|B_{2,y}/B_{2,z}|$ will hold true when $$\frac{B_{1,y}}{B_{1,z}} = 3 \cdot \frac{y \cdot \left(\frac{-\Delta}{2}\right)}{2 \cdot \left(\frac{-\Delta}{2}\right)^2 - y^2} \text{ and } \frac{B_{2,y}}{B_{2,z}} = 3 \cdot \frac{y \cdot \left(\frac{\Delta}{2}\right)}{2 \cdot \left(\frac{\Delta}{2}\right)^2 - y^2}$$

It is known that $\sqrt{y^2+(-\Delta/2)^2}=\sqrt{y^2+(\Delta/2)^2}=r_1=r_2$.

Using the equation for $B_{1,y}/B_{1,z}$ or $B_{2,y}/B_{2,z}$ above and the quadratic $$y = \frac{\Delta}{4 \cdot \frac{B_{1,y}}{B_{1,z}}} \cdot \left( \sqrt{8 \cdot \left( \frac{B_{1,y}}{B_{1,z}} \right)^2 + 9} - 3 \right),$$

x, y, and z can solved for as $$x = 0,$$

$$y = \frac{\Delta}{4 \cdot \frac{B_{1,y}}{B_{1,z}}} \cdot \left( \sqrt{8 \cdot \left( \frac{B_{1,y}}{B_{1,z}} \right)^2 + 9} - 3 \right), \text{ and}$$

$$z_i = (-1)^i \cdot \frac{\Delta}{2}.$$

The constants $k_i$ can be determined using the equation for the y or z component of the fields.

One skilled in the art will appreciate that the procedure for calibration as described herein may also be accomplished while the downhole tool assembly is below ground, during a boring operation. In such a case, the receiving assembly 26 may be moved along the drill string 16 and the downhole tool assembly 24, with the receiving assembly maintained in a vertical plane containing the first beacon and the second beacon, directly above the downhole tool assembly. That relationship would ensure the y-axis coordinate be maintained at 0. The receiving assembly 26 would again be stopped when the signal strength ratio $|B_{1,x}/B_{1,z}|=|B_{2,x}/B_{2,z}|$ holds true. The system equations can then be solved for the constant ki.

Additionally, the receiving assembly 26 can be programmed for calibration during a boring operation if the receiving assembly is not directly above the first beacon 30 or the second beacon 32. Where the receiving assembly is not directly above the first beacon 30 or the second beacon 32, the values $z \neq 0$ and $z-\Delta \neq 0$. In such a case, the six equations for the component fields can be solved for the five unknown variables, x, y, z, $k_f$ and $k_r$. The constants $k_f$ and $k_r$ can then be determined using the signal strengths and the distance between the beacons 30 and 32.

It is clear that the present invention is well adapted to attain the ends and advantages mentioned as well as those inherent therein. While the presently preferred embodiments of the invention have been described for purposes of this disclosure, it will be understood that numerous changes may be made in the combination and arrangement of the various parts, elements and procedures described herein without departing from the spirit and scope of the invention as defined in the following claims.

What is claimed is:

1. A system for use with a horizontal directional drilling machine to monitor a position of a downhole tool assembly, the system comprising:

a downhole tool assembly comprising:

a first beacon adapted to transmit a first electromagnetic signal; and a second beacon longitudinally separated from the first beacon and adapted to transmit a second electromagnetic signal; and a receiving assembly comprising:

a single antenna arrangement, the antenna arrangement comprising one and only one set of three mutually orthogonal antennas, each antenna adapted to detect the signals emanating from the first beacon and the second beacon; and a processor adapted to receive the detected signals from the antenna arrangement and to process the detected signals to determine a relative position of the receiving assembly to the downhole tool assembly.

2. The system of claim 1 wherein the second beacon is separated a known distance from the first beacon.

3. The system of claim 1 wherein the first electromagnetic signal is a first dipole field and the second electromagnetic signal is a second dipole field.

4. The system of claim 3 wherein the first dipole field is transmitted at a first frequency and the second dipole field is transmitted at a second frequency.

5. The system of claim 4 wherein the receiving assembly further comprises a first filter circuit operatively connected to the antenna arrangement and a second filter circuit operatively connected to the antenna arrangement.

6. The system of claim 1 wherein the mutually orthogonal antennas comprise ferrite rod antennas.

7. The system of claim 1 wherein the mutually orthogonal antennas comprise circuit boards.

8. The system of claim 1 wherein the mutually orthogonal antennas comprise circuit boards arranged as a cubic antenna.

9. The system of claim 1 wherein the receiving assembly further comprises a display adapted to visually communicate the relative position of the receiving assembly to the downhole tool assembly.

10. The system of claim 1 wherein the processor is adapted to process the detected signals to determine the distance from the antenna arrangement to the first beacon.

11. The system of claim 1 wherein the processor is adapted to process the detected signals to determine a lateral offset of the antenna arrangement from the first beacon.

12. The system of claim 11 wherein the determination of the lateral offset comprises determining a distance and a direction from the antenna arrangement to a position above the first beacon.

13. A method for monitoring a position of a downhole tool assembly during a horizontal drilling operation, the downhole tool assembly comprising a first beacon and a longitudinally separated second beacon both supported by the downhole tool assembly, wherein the first beacon is adapted to transmit a first locating signal and wherein the second beacon is adapted to transmit a second locating signal, the method comprising:

detecting the first locating signal transmitted by the first beacon and the second locating signal transmitted by the longitudinally separated second beacon at a monitoring point comprising one and only one set of three orthogonal antennas; and processing the detected first and second locating signals to determine a relative position of the monitoring point to the first beacon.

14. The method of claim 13 wherein the step of processing the first and second locating signals comprises determining a distance between the monitoring point and the first beacon.

15. The method of claim 13 wherein the step of processing the first and second locating signals comprises determining a lateral offset from the monitoring point to the first beacon.

16. The method of claim 15 wherein the step of determining the lateral offset comprises determining a distance and a direction from the monitoring point to a position above the first beacon.

17. The method of claim 13 farther comprising the step of calibrating a receiving assembly adapted to detect the locating signals.

18. The method of claim 17 wherein the step of calibrating the receiving assembly comprises:

placing the fast beacon and the second beacon in a substantially horizontal position;

moving the receiving assembly parallel to and in the same horizontal plane as the first beacon and the second beacon;

detecting a strength of the signals received from the first beacon and the second beacon;

and determining a constant value it when a strength of the signals received from the first beacon and the second beacon is the same using the strength of the signals received from the first beacon and the second beacon and the distance between the first beacon and the second beacon.

* * * * *

UNITED STATES PATENT AND TRADEMARK OFFICE

CERTIFICATE OF CORRECTION

PATENT NO. : 7,647,987 B2
APPLICATION NO. : 11/068170
DATED : January 19, 2010
INVENTOR(S) : Cole It is certified that error appears in the above-identified patent and that said Letters Patent is hereby corrected as shown below:

Column 9, line 1, please delete "farther" and substitute therefore --further--.

Column 9, line 6, please delete "fast" and substitute therefore --first--.

Column 10, line 3, please delete "it" and substitute therefore --k--.

Signed and Sealed this

Sixteenth Day of March, 2010

David J. Kappos

David J. Kappos
*Director of the United States Patent and Trademark Office*